US010392768B2

(12) United States Patent
Kemp et al.

(10) Patent No.: US 10,392,768 B2
(45) Date of Patent: Aug. 27, 2019

(54) PILE WITH SOIL DISPLACEMENT ASSEMBLY

(71) Applicant: Hubbell Incorporated, Shelton, CT (US)

(72) Inventors: Timothy Michael Kemp, Columbia, MO (US); Jonathan Michael Wilson, Columbia, MO (US); Gary Leonard Seider, Centralia, MO (US); Shawn David Downey, Columbia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/917,440

(22) Filed: Mar. 9, 2018

(65) Prior Publication Data

US 2018/0258602 A1 Sep. 13, 2018

Related U.S. Application Data

(60) Provisional application No. 62/470,114, filed on Mar. 10, 2017.

(51) Int. Cl.

| | |
|---|---|
| ***E02D 5/56*** | (2006.01) |
| ***E02D 7/22*** | (2006.01) |
| *E02D 5/80* | (2006.01) |

(52) U.S. Cl.

CPC ..... *E02D 5/56* (2013.01); *E02D 7/22* (2013.01); *E02D 5/801* (2013.01)

(58) Field of Classification Search

CPC .. E02D 5/56; E02D 5/36; E02D 5/801; E02D 7/22; E02D 5/52; E02D 5/38; E21B 10/44; E21B 7/26

See application file for complete search history.

(56) References Cited

U.S. PATENT DOCUMENTS

| | | | |
|---|---|---|---|
| 153,807 | A | 8/1874 | Collins |
| 2,613,062 | A | 12/1950 | Harbert |
| 3,382,937 | A | 5/1968 | Watts |
| 4,623,025 | A | 11/1986 | Verstraeten |
| 5,252,009 | A | 10/1993 | Bossler |
| 5,707,180 | A | 1/1998 | Vickars et al. |
| 5,722,498 | A | 3/1998 | Van Impe |
| 6,082,472 | A | 7/2000 | Verstraeten |
| 6,264,402 | B1 | 7/2001 | Vickars et al. |
| 6,722,821 | B1 | 4/2004 | Perko |

(Continued)

FOREIGN PATENT DOCUMENTS

| | | |
|---|---|---|
| DE | 3314125 | 10/1984 |
| JP | 2001040662 | 2/2001 |

(Continued)

OTHER PUBLICATIONS

International Search Report and Written Opinion mailed in corresponding Application PCT/US18/21857 dated May 30, 2018 (10 pages).

*Primary Examiner* — Carib A Oquendo
(74) *Attorney, Agent, or Firm* — Wissing Miller LLP

(57) ABSTRACT

Soil displacement piles having a shaft and one or more soil displacement assemblies coupled to the shaft such that the one or more soil displacement assemblies are movable relative to the shaft are provided. Each soil displacement assembly has an upper plate, a lower plate, a reamer between the upper and lower plates and secured to each plate, and at least one soil displacement arm extending from the lower plate.

36 Claims, 16 Drawing Sheets

(56) References Cited

U.S. PATENT DOCUMENTS

| | | | |
|---|---|---|---|
| 6,834,733 | B1 | 12/2004 | Maouche et al. |
| 7,040,842 | B2 | 5/2006 | Stotzer |
| 7,241,079 | B2 | 7/2007 | Francis |
| 7,494,299 | B1 | 2/2009 | Whitsett |
| 7,571,781 | B2 | 8/2009 | Stoetzer |
| 7,748,932 | B2 | 7/2010 | Lindsey |
| 7,854,451 | B2 | 12/2010 | Davis, II |
| 8,033,757 | B2 | 10/2011 | Stroyer |
| 8,845,236 | B1 | 9/2014 | Dosdourian et al. |
| 9,416,513 | B2 | 8/2016 | Kemp |
| 9,422,741 | B1 | 8/2016 | Conte |
| 2002/0150430 | A1 | 10/2002 | Vickars et al. |
| 2005/0031418 | A1 | 2/2005 | Whitsett |
| 2006/0013656 | A1 | 1/2006 | Blum |
| 2008/0302828 | A1 | 12/2008 | Lewenhoff |
| 2010/0054864 | A1 | 3/2010 | Stroyer |
| 2010/0263928 | A1 | 10/2010 | Massari |
| 2012/0087740 | A1 | 4/2012 | Stroyer |
| 2013/0101360 | A1 | 4/2013 | Lutenegger et al. |
| 2013/0343823 | A1 | 12/2013 | Lin |
| 2014/0286712 | A1 | 9/2014 | Lutenegger et al. |
| 2015/0117960 | A1 | 4/2015 | Kemp et al. |
| 2016/0186402 | A1 | 6/2016 | Tomchesson et al. |

FOREIGN PATENT DOCUMENTS

| | | |
|---|---|---|
| JP | 2010222853 | 10/2010 |
| JP | 2012067562 | 4/2012 |
| JP | 2012077537 | 4/2012 |

PILE WITH SOIL DISPLACEMENT ASSEMBLY

CROSS REFERENCE TO RELATED APPLICATIONS

The present disclosure is based on and claims benefit from U.S. Provisional Application Ser. No. 62/470,114 filed Mar. 10, 2017 entitled "Pile with Soil Displacement Assembly" the entire contents of which are incorporated herein by reference.

BACKGROUND

Field

The present disclosure relates generally to foundation systems and in particular to pile foundation systems that use a screw to pull a shaft through soil and a soil displacement assembly to push the soil radially outward to form a cavity in which filler is poured.

Description of the Related Art

Piles are often required to be placed into the ground for providing support for foundations or other structures. It is desirable to install such piles quickly and efficiently so as to reduce construction costs. Often it is beneficial to form the piles in place, i.e., at the job site. One conventional method for forming piles at the job site involves inserting a flat disk on a shaft down through the soil by turning a screw at a lower end of a shaft. The disk clears a cylindrical region around the shaft. The cylindrical region is filled with grout to encapsulate the shaft. Another conventional method for forming piles at the job site involves placing a helical pile that appears to have an elongated pipe with a central chamber in the soil. The pipe has a helical blade with an opening in the trailing edge of the blade where grout is extruded. The grout fills the portions of the soil disturbed by the blade. The present disclosure provides a new system to form pile columns at the job site.

SUMMARY

The present disclosure provides configurations of soil displacement assemblies and soil displacement pile leads and extensions with such soil displacement assemblies that facilitate the formation of composite pile columns. The soil displacement assemblies push the soil so as to displace the soil radially outwardly away from a shaft of the soil displacement pile lead and any extensions to form a cavity in which filler can be poured to at least partially encapsulate the pile leads and any extensions. In an exemplary embodiment, the soil displacement assembly includes an upper plate having a central opening configured to receive a shaft of a pile lead or extension, a lower plate having a central opening configured to receive the shaft of a pile lead or extension, a reamer between the upper and lower plate and secured to each plate, and at least one soil displacement arm extending from the lower plate and having a soil contacting surface capable of displacing soil radially outwardly.

In an exemplary embodiment, the soil displacement pile includes a shaft and at least one soil displacement assembly coupled to the shaft. The at least one soil displacement assembly includes an upper plate having a central opening configured to receive a shaft of a pile lead or extension, a lower plate having a central opening configured to receive the shaft of a pile lead or extension, a reamer between the upper and lower plate and secured to each plate, and at least one soil displacement arm extending from the lower plate and having a soil contacting surface capable of displacing soil radially outwardly.

In an exemplary embodiment, the soil displacement pile includes a lead shaft having a lead head portion, a lead end portion and at least one plate secured to the lead shaft toward the lead end portion, at least one soil displacement assembly coupled to the lead shaft, an extension shaft having an extension head portion and an extension end portion, and at least one soil displacement assembly coupled to the extension shaft. The at least soil displacement assembly on the lead shaft and the extension shaft includes an upper plate having a central opening configured to receive the lead shaft or the extension shaft, a lower plate having a central opening configured to receive the lead shaft or the extension shaft, a reamer between the upper and lower plate and secured to each plate, and at least one soil displacement arm extending from the lower plate and having a soil contacting surface capable of displacing soil radially outwardly.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The present disclosure provides configurations of soil displacement assemblies and soil displacement pile leads and extensions with such soil displacement assemblies that facilitate the formation of composite pile columns. The soil displacement assemblies push the soil so as to displace the soil radially outwardly away from a shaft of the soil displacement pile lead and any extensions to form a cavity in which filler can be poured to at least partially encapsulate the pile leads and any extensions. The cured filler with the embedded soil displacement pile form the composite pile column. The composite pile column is provided to carry a load or a portion of a load. For ease of description the word "filler" is used when describing the material being poured into the cavity. The filler may include grout, cement, concrete or other suitable material that can be poured into the cavity and hardened to form the composite pile column.

Figure 1:
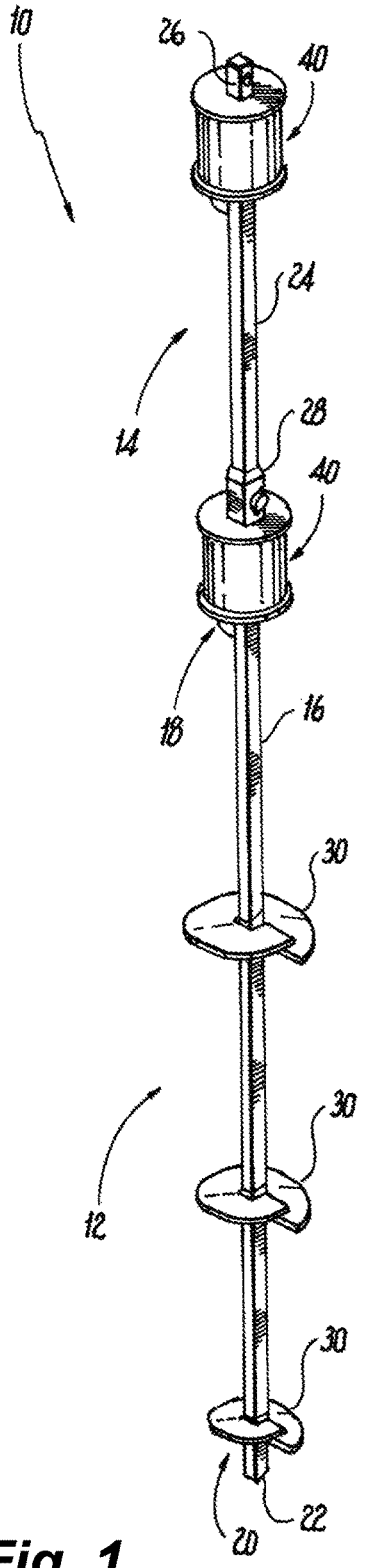
FIG. 1 is a perspective view of an exemplary embodiment of a soil displacement pile having a lead and an extension each having a soil displacement assembly.
Figure 2:
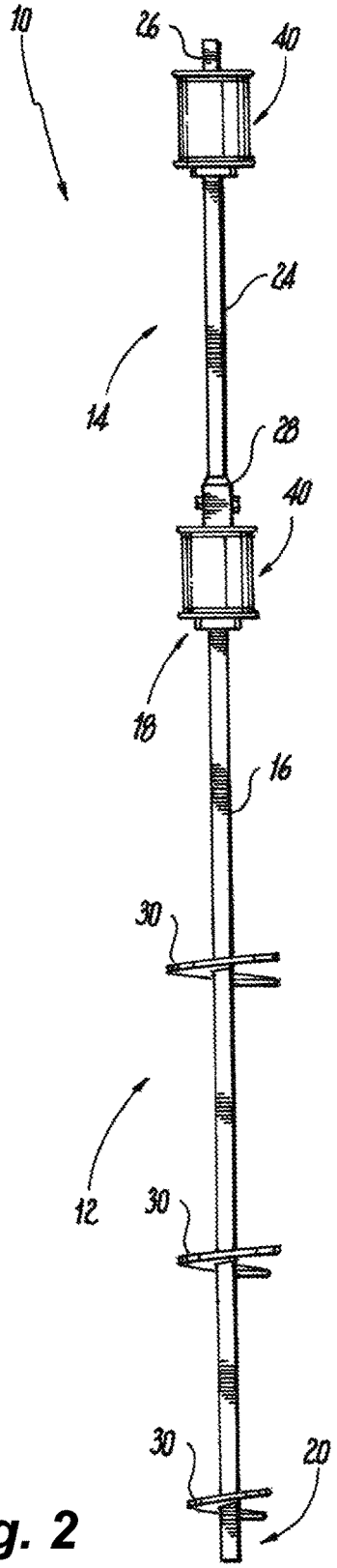
FIG. 2 is a side elevation view of the soil displacement pile of FIG. 1.

Referring to FIGS. 1 and 2, an exemplary embodiment of a soil displacement pile according to the present disclosure is shown. The soil displacement pile 10 has a lead 12 and possibly one or more extensions 14. The lead 12 comprises a square or round shaft or pipe 16 and at least one soil displacement assembly 40. The lead shaft 16, which is the bottom most shaft of soil displacement pile 10, has a lead head portion 18 and a lead end portion 20. The lead end portion 20 is configured to first penetrate the soil and terminates at its distal end with a tapered tip 22. Each of the one or more extensions 14 comprise a square or round shaft or pipe 24 and at least one soil displacement assembly 40. Each extension shaft 24 has an extension head portion 26 and an extension end portion 28. The first extension added to the soil displacement pile 10 is secured to the lead 12 where the extension end portion 28 is mated with the lead head portion 18 using one or more nut and bolt (not shown). Subsequent extensions may be sequentially joined together where the extension end portion 28 of the next-in-line extension 14 is mated with the extension head portion 26 of the previous extension 14 using one or more nut and bolt. The lead shaft 16 and the extension shaft 24 can be hollow or solid, and the shafts 16 and 24 can be made of metal, e.g., steel or galvanized steel, or carbon fiber, or other suitable material known in the art.

Figure 11A:
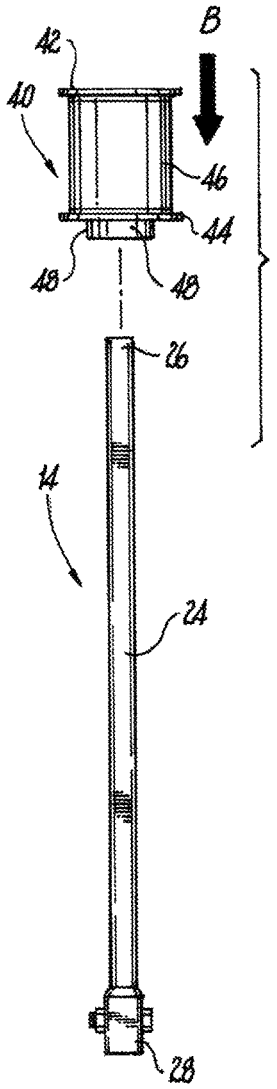
FIG. 11A is a side elevation view with parts separated of the soil displacement pile extension of FIG. 1.
Figure 11B:
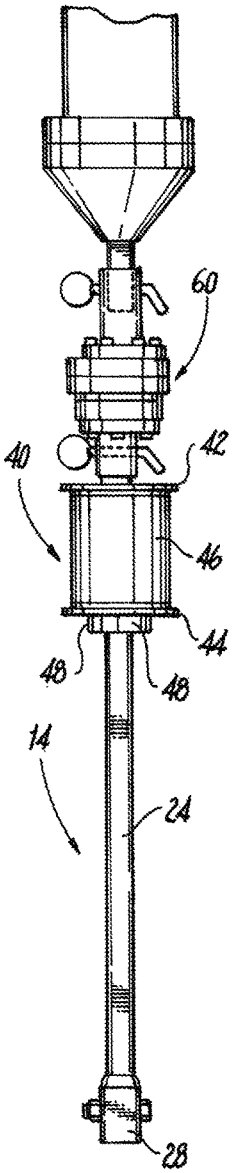
FIG. 11B is a side elevation view of the soil displacement extension of FIG. 11A, illustrating a drive system connected to an extension head portion of the soil displacement extension and a soil displacement assembly contacting the drive system.
Figure 11C:
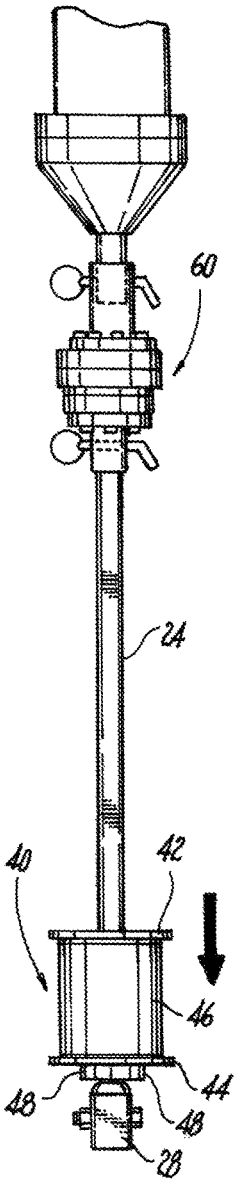
FIG. 11C is a side elevation view of the soil displacement extension of FIG. 11B, illustrating the soil displacement assembly contacting an extension end portion of the soil displacement extension.

As noted, the extensions 14 are optional such that the lead 12 may comprise the soil displacement pile 10 and a pile drive system head 60, as shown in FIGS. 11B and 11C is used to rotate the lead 12 to drive the lead 12 into the soil. If one or more extensions 14 are added to the lead 12, then the lead 12 and the one or more extensions form the soil displacement pile 10 and the pile drive system head 60 is used to first rotate the lead 12 to drive the lead into the soil and then each extension is successively driven into the soil.

Figure 3:
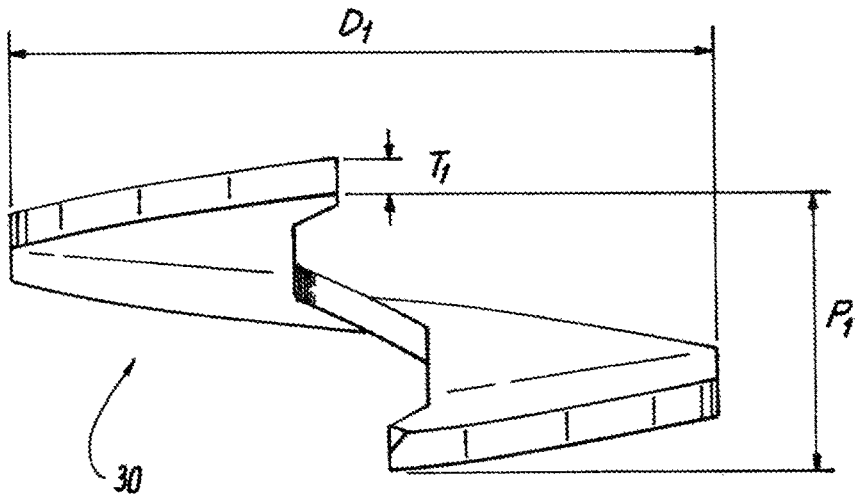
FIG. 3 is a side elevation view of an exemplary embodiment of a helical plate used with the soil displacement pile lead.

Referring to FIGS. 1-3, the lead 12 has one or more load bearing helical plates 30. The helical plates 30 are provided to facilitate screwing the lead 12 and any extensions 14 attached to the lead 12 into the soil. The helical plates 30 may also carry a portion of the load carried by the composite pile column. In some embodiments, the lead 12 can have a single load bearing helical plate 30 secured to the lead shaft 16 typically in proximity to the lead end portion 20, and in other embodiments the lead can have multiple load bearing helical plates 30 secured to the lead shaft 16. In the event multiple load bearing helical plates 30 are secured to the lead shaft 16, as shown, the load bearing helical plates 30 may have the same diameter or the load bearing helical plates 30 may have different diameters that are in, for example, a tapered arrangement. To illustrate a tapered arrangement, the smallest diameter load bearing helical plate 30 may be positioned closest to the tapered tip 22 of the lead shaft 16, and the largest load bearing helical plate 30 may be positioned at a distance away from the tapered tip 22. Such load bearing helical plates 30 on the lead shaft 16 may be spaced apart at a distance sufficient to facilitate the screwing of the soil displacement pile 10 into the soil and to promote plate load bearing capacity of the plates 30. Promoting the load bearing capacity of the load bearing plates is to say that the load bearing helical plates 30 may assist other features described herein of the overall soil displacement pile in resisting an applied load. The dimensions of the load bearing helical plates 30 may vary depending upon various considerations, including the load the soil displacement pile 10 is to carry and the condition of the soil such as the type and density of the soil. As an example and referring to FIG. 3, the diameter "$D_1$" of each load bearing helical plate 30 may range from between about 6 inches to about 16 inches. The pitch "$P_1$" of each load bearing helical plate 30 may range from between about 2 inches and about 4 inches. The thickness "$T_1$" of each helical plate 30 may range from between about ⅜ inch and about ¾ inch.

As noted, the lead 12 and/or extensions 14 according to the present disclosure may include one or more soil displacement assemblies 40 configured to be coupled to the lead shaft 16 and/or the extension shaft 24 and movable relative to the respective shaft. An exemplary embodiment a soil displacement assembly 40 according to the present disclosure is shown in FIGS. 4-7. The soil displacement assembly 40 according to this exemplary embodiment includes, an upper plate 42, a lower plate 44, a reamer 46 and one or more soil displacement arms or paddles 48.

Figure 5:
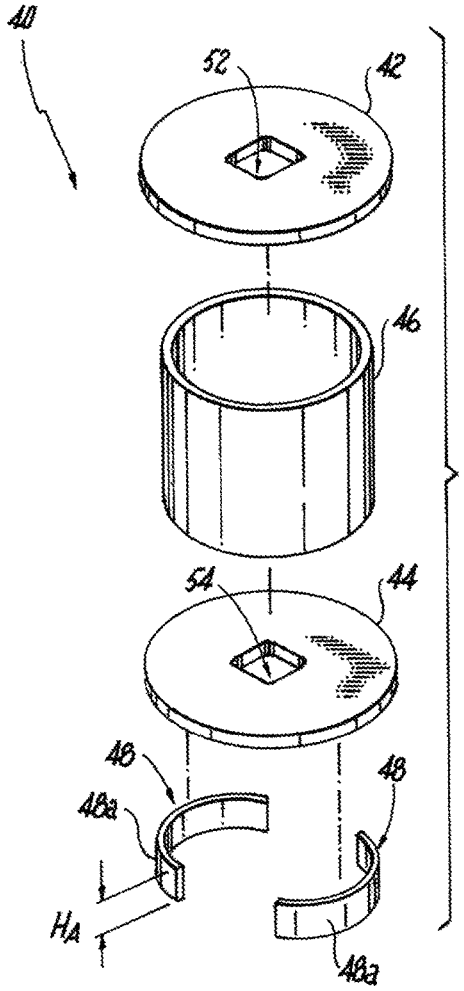
FIG. 5 is a top perspective view with parts separated of the soil displacement assembly of FIG. 4, illustrating the upper plate, lower plate, reamer and the soil displacement arms.
Figure 6:
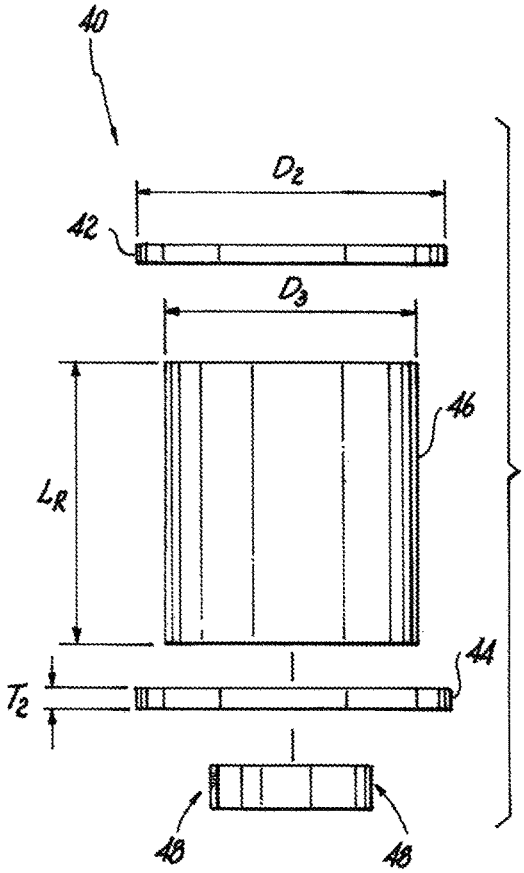
FIG. 6 is a side elevation view with parts separated of the soil displacement assembly of FIG. 4, illustrating the upper plate, lower plate, reamer and the soil displacement arms.

Referring to FIG. 5, the upper and lower plates 42 and 44 are in this exemplary embodiment circular, flat plates. However, the upper and lower plates may have other shapes, such as formed plates as described herein below. The upper plate 42 includes a central opening 52 and the lower plate 44 includes a central opening 54. The central openings 52 and 54 are preferably shaped to conform to the shape of the lead shaft 16 or the extension shaft 24 so that the shaft 24 can pass through the soil displacement assembly 40 as described below. The upper plate 42 may also include one or more filler holes 56, seen in FIG. 8, and the lower plate 44 may include one or more filler holes 58, seen in FIG. 7. The filler holes 56 and 58 allow filler to flow through the plates as the soil displacing pile 10 is driven into the soil. The diameter "$D_2$" of the upper plate 42 and the lower plate 44 depends upon the desired width of the cavity and thus the size of the composite pile column created by the cured filler and soil displacement pile 10. For example, the diameter "$D_2$" of the upper and lower plates may range from between about 6 inches to about 16 inches. The diameter "$D_2$" of the upper and lower plates 42 and 44 may be the same, as shown in FIG. 6, or they may differ. More specifically, the upper plate 42 may have a diameter that is larger than the lower plate 44, or the upper plate 42 may have a diameter that is smaller than the lower plate 44. For example, the diameter of the upper plate 42 may be about 16 inches and the diameter of the lower plate 44 may be 6 inches. As another example, the diameter of the upper plate 42 may be about 8 inches and the diameter of the lower helical plate 44 may be 12 inches. The upper and lower plates 42 and 44 have a thickness "$T_2$" that is suitable to perform the soil displacement function of the soil displacement assembly 10. As a non-limiting illustration, the thickness "$T_2$" of the plates may be in the range from between about ⅜ inch and about ¾ inch. The upper and lower plates 42 and 44 can be made of metal, e.g., steel or galvanized steel, or carbon fiber, or other suitable material known in the art.

Figure 4:
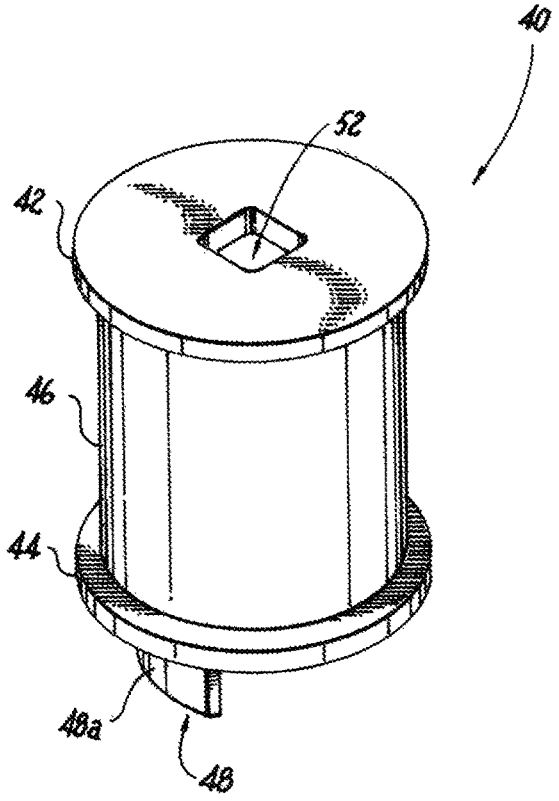
FIG. 4 is a top perspective view of the soil displacement assembly of FIG. 1, illustrating an upper plate, a lower plate, a reamer between the upper and lower plates and a portion of a soil displacement arm attached to the lower plate.

The reamer 46 is secured to the upper and lower plates 42 and 44 by for example, by welds, mechanical fasteners or other known fastening techniques, as shown in FIG. 4. The reamer 46 is preferably hollow so that the shaft 16 of the lead 12 or the shaft 24 of the extension 14 can pass through the reamer 46 as described below. However, the reamer 46 may be a solid member with a central opening that can be aligned with the central openings in the upper and lower plates 42 and 44 so that the lead shaft 16 or an extension shaft 24 can pass through the reamer 46. In the exemplary embodiment shown in FIGS. 4 and 5, the reamer 46 is circular or tubular in shape. However, one skilled in the art would readily appreciate that the reamer 46 may have a square shape, a hexagon shape, a pentagon shape or other shape suitable to provide lateral stability to the lead shaft 16 or extension shaft 24. The reamer 46 may also maintain the shape of the cavity in which filler can be poured. The diameter "$D_3$" or outer width of the reamer 46 is preferably less than the diameter "$D_2$" of the smaller of the plates 42 or 44. The upper and lower plates 42 and 44 are separated by the reamer 46, such that the length "$L_R$" of the reamer 46 defines the separation between the upper and lower plates 42 and 44. The length "$L_R$" is based upon various considerations, including for example, the diameter "$D_2$" of the upper and lower plates 42 and 44, and the expansion and/or contraction properties of the soil. As a non-limiting example, the distance "$L_R$" can range from between about 5 inches to about 16 inches. Further, one skilled in the art would recognize that the size, shape and length of the reamer 46 may vary depending upon various considerations, including for example, the expansion and/or contraction properties of the soil, the capacity requirements of the soil displacement pile 10, and the strength and/or type of soil to be encountered. The reamer 46 can be made of metal, e.g., steel or galvanized steel, or carbon fiber, or other suitable material known in the art.

Figure 7:
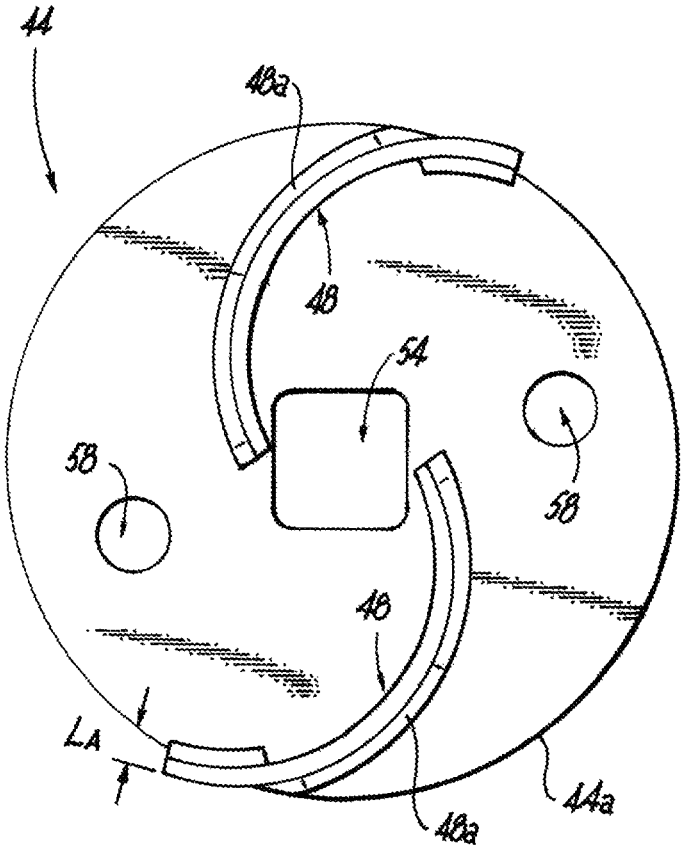
FIG. 7 is a bottom plan view of the lower plate of the soil displacement assembly of FIG. 4, illustrating the soil displacement arms secured to a bottom surface of the lower plate and filler openings in the lower plate.
Figure 8:
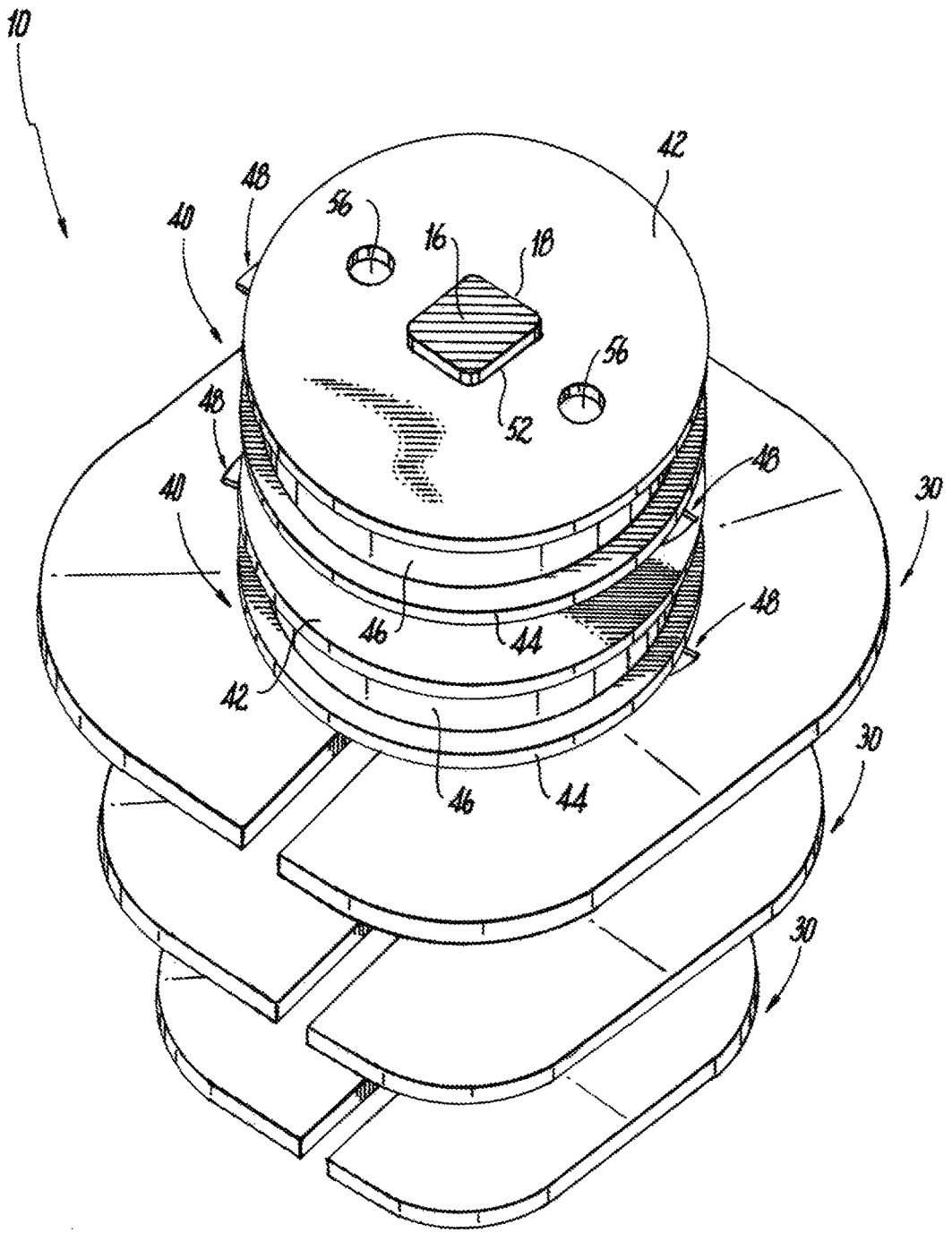
FIG. 8 is a top perspective view of the soil displacement pile of FIG. 1, illustrating a relationship between the helical plates on the lead and the soil displacement assemblies.

The one or more soil displacement arms or paddles 48 are secured to a bottom surface of the lower plate 44, as shown in FIG. 7. In the embodiment shown, there are two soil displacement arms 48. However, one or more than two soil displacement arms 48 may be used. Each soil displacement arm 48 is arcuate in shape and preferably has a first end positioned adjacent an outer edge 44*a* of the lower plate 44 and a second end adjacent the central opening 54, as shown. Preferably, the first end of each soil displacement arm extends beyond the outer edge 44*a* of the lower plate a distance "$L_A$." The distance "$L_A$" is preferably set so that the soil displacement arms 48 can push the soil so as to displace the soil radially outwardly away from a shaft of the soil displacement pile lead 10 and any extensions to form the cavity in which filler can be poured. As a non-limiting example, the distance "$L_A$" can be in the range from between about 0 and about ¾ of an inch. In another embodiment, each soil displacement arm 48 may have a first end positioned adjacent an outer edge 44*a* of the lower plate 44 as described above, and a second end ending at a point between the outer edge 44*a* and the central opening 54. To facilitate the pushing of the soil, each soil displacement arm 48 is oriented on the lower plate 44 so that a soil contacting surface 48*a*, e.g., the convex surface, can engage the soil as the soil displacement pile 10 is being driven into the soil. In the embodiment shown, the soil contacting surfaces 48*a* are oriented so that clockwise motion of the soil displacement pile 10 causes the soil contacting surfaces 48*a* to engage the soil.

As noted, each soil displacement arm 48 shown is arcuate such that it has a curvature. The radius of the curvature of the soil displacement arm 48 may vary depending upon, for example, the type of soil to be encountered and the relative density of the soil to be encountered. The radius of the curvature of each soil displacement arm 48 may be in the range of about 30 degrees to about 180 degrees. The soil contacting surface 48*a* has a height $H_A$, seen in FIG. 5, which is typically equal to or greater than the helix pitch divided by the number of soil displacement arms 48. As an example, if the pitch range is between 2-4 inches and there are two the soil displacement arms 48, the height $H_A$ would be between 1-2 inches. In another embodiment, the soil contacting surface 48*a* may vary and may be irregular so long as the soil contacting surface 48*a* is capable of displacing soil outwardly as the soil displacement pile 10 is being driven into the soil.

The vertical orientation of each soil displacement arm 48 may vary depending upon a number of considerations such as the location along the lower plate and the radius of curvature. For example, in the configuration shown in FIGS. 5 and 7, the soil displacement arms 48 are secured to the lower plate 44 so that the soil displacement arms 48 would be substantially vertical relative to the plate or the shaft 16 of the lead 12 or the shaft 24 of the extension 14 passing through the central opening 54. As another example, each soil displacement arm 48 may be angled or tilted relative to the plate or the shaft 16 of the lead 12 or the shaft 24 of the extension 14 passing through the central opening 54.

Figure 9:
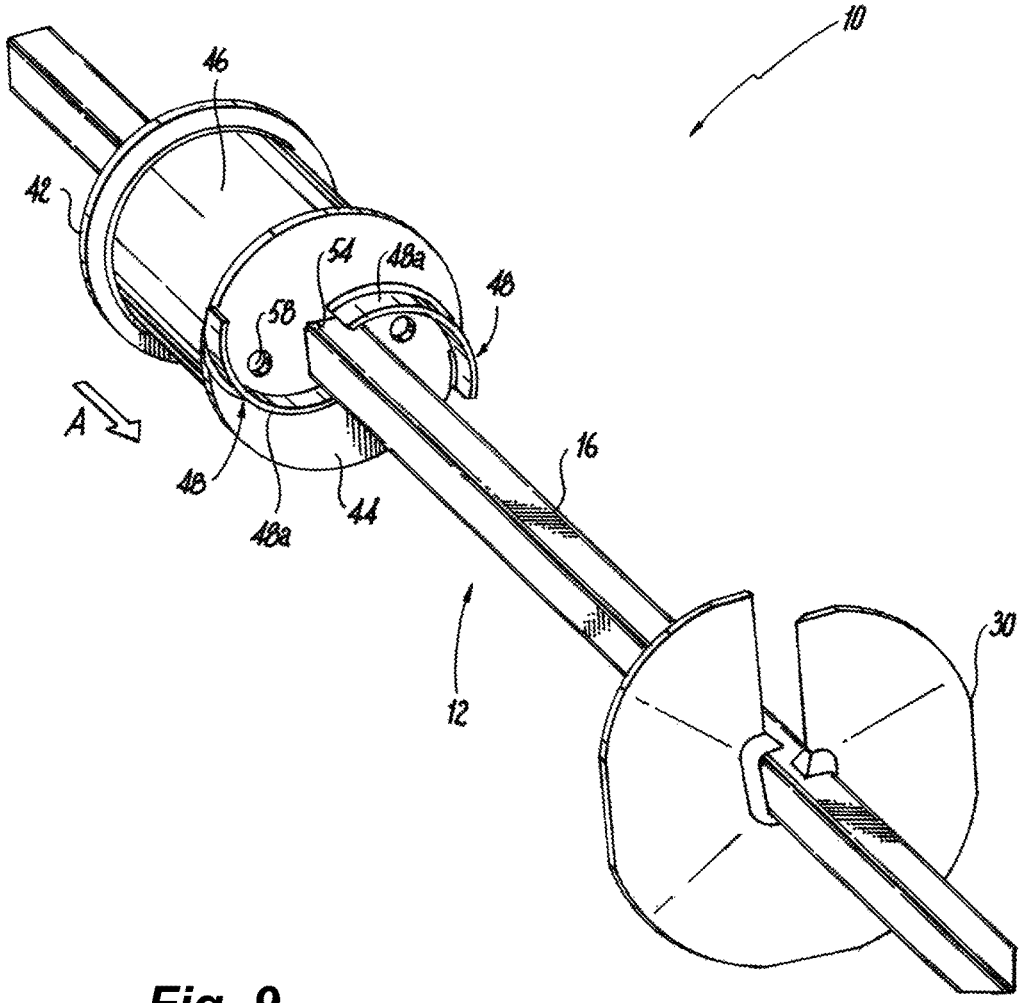
FIG. 9 is a bottom perspective view of a portion of the soil displacement pile lead of FIG. 1, illustrating a soil displacement assembly and an upper most helical plate.
Figure 10A:
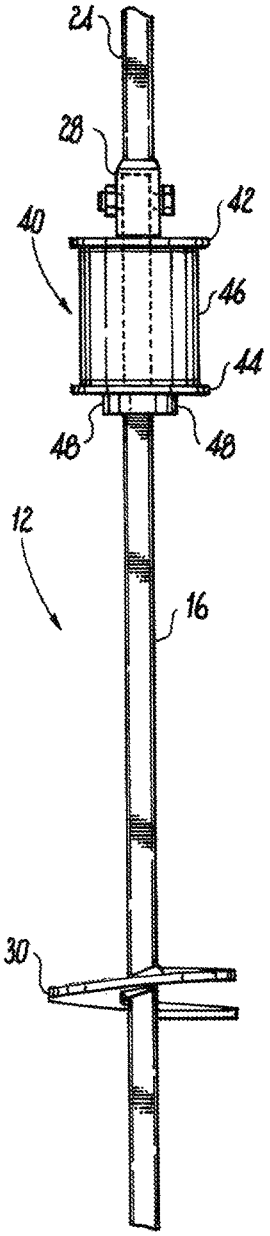
FIG. 10A is a side elevation view of a portion of the soil displacement pile lead of FIG. 1, illustrating a soil displacement assembly at a lead head portion of the lead shaft contacting an extension end portion of an extension secured to the lead head portion.
Figure 10B:
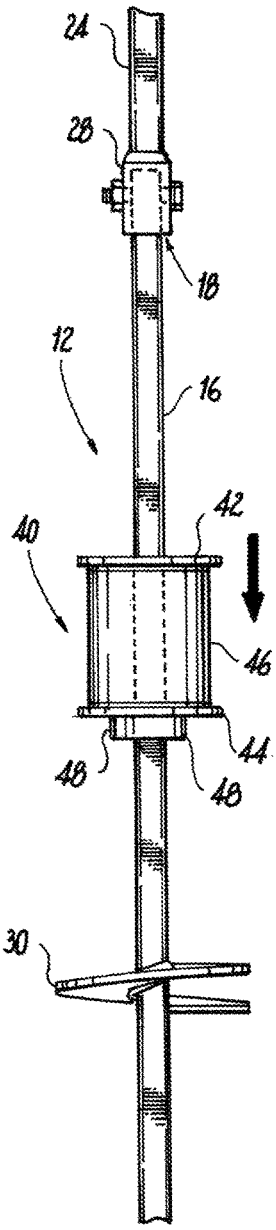
FIG. 10B is a side elevation view of the soil displacement pile lead of FIG. 10A, illustrating the soil displacement assembly at a point along the lead shaft between the lead head portion and an upper most helical plate on the lead shaft.
Figure 10C:
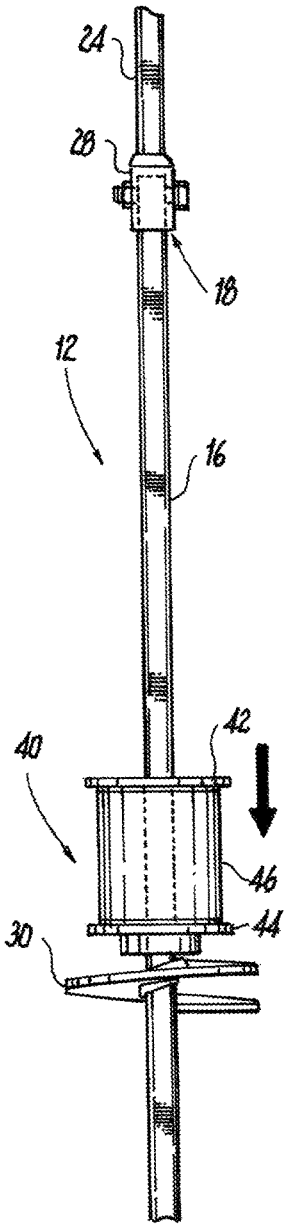
FIG. 10C is a side elevation view of the soil displacement pile lead of FIG. 10A, illustrating the soil displacement assembly contacting the upper most helical plate on the lead shaft.

Referring to FIGS. 8-10C, to couple one or more soil displacement assemblies 40 to a lead shaft 16, the lead head portion 18 of the shaft 16 is passed through the central opening 54 in the lower plate 44, through the hollow reamer 46 and through the central opening 52 in the upper plate 42, as shown by the direction of arrow A in FIG. 9. The soil displacement assembly 40 is then freely movable along the lead shaft 16 between the lead head portion 18 and the upper most helical plate 30, as shown in FIGS. 10A-10C. When a drive system head 60 or extension 14 is attached to the lead head portion 18, the drive system head 60 or extension act as a stop to prevent the soil displacement assembly 40 from being removed from the lead head portion 18 of the lead shaft 16. Similarly, the upper most helical plate 30 also acts as a stop to prevent the soil displacement assembly 40 from being removed from the lead end portion of the lead shaft 16. To illustrate, in FIG. 10A the soil displacement assembly 40 is contacting an extension end portion 28 of an extension shaft 24 which is acting as a stop to prevent the soil displacement assembly 40 from being removed from lead head portion 18 of the lead shaft 16. In FIG. 10B the soil displacement assembly 40 is at a point along the lead shaft 16 between the extension end portion 28 of extension shaft 24 and the upper most helical plate 30. In FIG. 10C the soil displacement assembly 40 is contacting the upper most helical plate 30 which also acts as a stop to prevent the soil displacement assembly 40 from being removed from the lead end portion 20 of the lead shaft 16.

Referring now to FIGS. 11A-11C, to couple one or more soil displacement assemblies 40 to an extension shaft 24, the extension head portion 26 of the shaft 24 is passed through the central opening 54 in the lower plate 44, through the hollow reamer 46 and through the central opening 52 in the upper plate 42, as shown by arrow "B" in FIG. 11A. The soil displacement assembly 40 is then freely movable along the extension shaft 24 between the extension head portion 26 and the extension end portion 28, as shown in FIGS. 11B and 11C. When a drive system head 60 or a next-in-line extension 24 is attached to the extension head portion 26, the drive system 60 or extension end portion 28 of the next-in-line extension 24 act as a stop to prevent the soil displacement assembly 40 from being removed from extension head portion 26 of the extension shaft 24. Similarly, the extension end portion 28 also acts as a stop to prevent the soil displacement assembly 40 from being removed from the extension end portion 28 of the extension shaft 24. To illustrate, in FIG. 11B the soil displacement assembly 40 is contacting a drive system head 60 connected to the extension head portion 26 which is acting as a stop to prevent the soil displacement assembly 40 from being removed from extension head portion 26 of the extension shaft 24. In FIG. 11C the soil displacement assembly 40 is contacting the extension end portion 28 of the extension shaft 24 which also acts as a stop to prevent the soil displacement assembly 40 from being removed from the extension end portion of the extension shaft 24.

Figure 12:
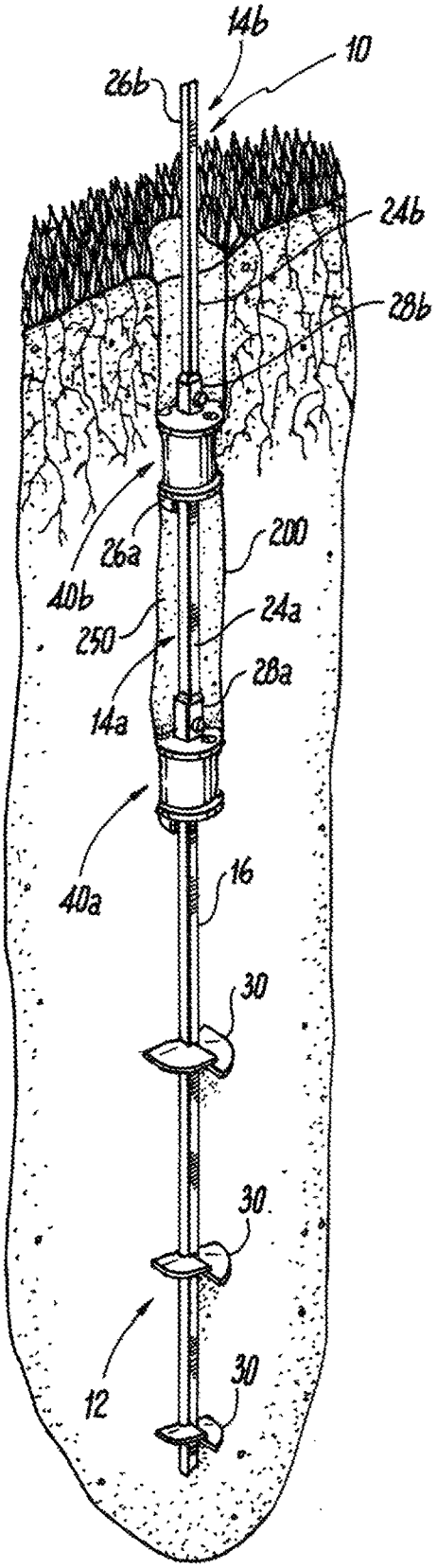
FIG. 12 is a top perspective view of the soil displacement pile of FIG. 1 being driven into the soil with soil displacement assemblies creating a cavity in which filler is poured.
Figure 13:
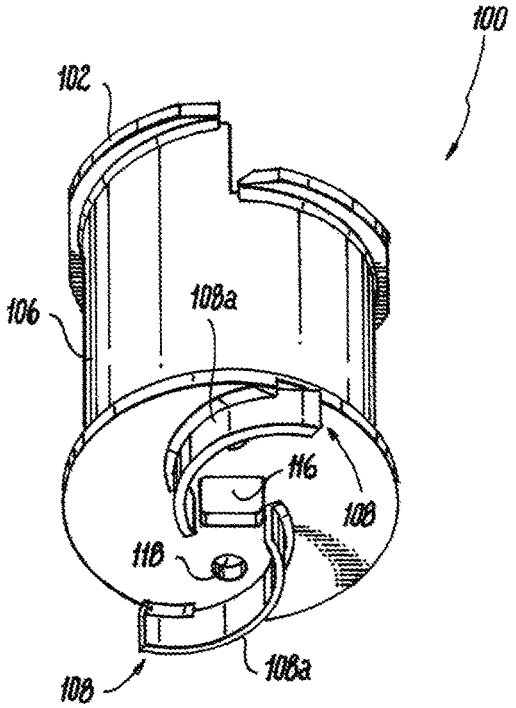
FIG. 13 is a bottom perspective view of another exemplary embodiment of a soil displacement assembly according to the present disclosure, illustrating a formed upper plate, a flat lower plate, a reamer between the upper and lower plates and soil displacement arms attached to the lower plate.

In operation and referring to FIG. 12, as the soil displacement pile 10 is driven into the ground the helical plates 30 cut through or screw into the soil. As the lead head portion 18 of the lead shaft 16 is in close proximity to the ground, an extension end portion 28*a* of an extension 14*a* is attached to the lead head portion 18 and the extension head portion 26*a* is connected to the drive system head 60 to continue to drive the soil displacement pile 10 into the soil. When the first soil displacement assembly 40*a* contacts the soil, the soil displacement assembly 40*a* begins to slide along the lead shaft 16 until the soil displacement assembly 40*a* contacts the extension end portion 28*a* of the first-in-line extension 14*a*. The extension end portion 28*a* acts as a stop preventing further upward movement of the soil displacement assembly 40*a* allowing the soil displacement assembly 10 to begin to create the cavity 200 in which filler 250 will be poured. As the soil displacement assembly 40*a* penetrates the soil, the soil displacement arms 48 push the soil so as to displace the soil radially outwardly away from a lead shaft 16 to form the cavity 200. In addition, as the first-in-line extension 14*a* is being driven into the soil, filler is poured into the cavity 200. The filler 250 may pass through filler openings 56 in the upper plate 42 to fill the reamer 46 with filler 250 to provide a continuous distribution of filler through the cavity 200. It should be noted that the upper plate 42 and the lower plate 44 define the cavity 200 and the reamer 46 is provided for lateral stability of the lead 12 and any extensions 14. In addition, the reamer 46 may help maintain the shape of the cavity 200.

Once the soil displacement extension head portion 26*a* is in close proximity to the ground, an extension end portion 28*b* of a next-in-line extension shaft 24*b* is secured to the extension head portion 26*a* of the first-in-line extension 14*a*. The extension head portion 26*b* of the second-in-line extension 14*b* is then connected to the drive system head 60 to continue to drive the soil displacement pile 10 into the soil. When the second soil displacement assembly 40*b* contacts the ground, the soil displacement assembly slides along the extension shaft 24*a* until the soil displacement assembly contacts the extension end portion 28*b* of the next-in-line extension shaft 24*b*. The extension end portion 28*b* acts as a stop preventing further upward movement of the soil displacement assembly 40*b* allowing the soil displacement assembly to continue to create the cavity 200 in which filler 250 will be poured. As the soil displacement assembly 40*b* continues to penetrate the soil, the soil displacement arms 48 push any residual soil and filler 250 so as to displace the soil and filler radially outwardly away from the extension shaft 24*a* to reinforce the cavity 200. As noted, the upper plate 42 and the lower plate 44 define the cavity 200 and the reamer 46 reinforces the cavity 200. As the second-in-line extension 14*b* is being driven into the soil, filler 250 is again poured into the cavity 200. The filler 250 can pass through the filler openings 56 in the upper plate 42 to fill the reamer 46 with filler 250 and the filler openings 58 in the lower plate 44 in the second soil displacement assembly 40*b* allows filler 250 in the reamer 46 to flow into the cavity 200 to provide a continuous composite pile when the filler cures.

Referring now to FIGS. 13-17, another exemplary embodiment of the soil displacement assembly 100 according to the present disclosure that can be included on the lead 12 or one or more extensions 14 is shown. The soil displacement assembly 100 according to this exemplary embodiment includes, an upper plate 102, a lower plate 104, a reamer 106 and one or more soil displacement arms or paddles 108.

The upper plate 102 is in this exemplary embodiment a circular, formed plate, where the formed upper plate 102 is a helical plate. The dimensions of the helical upper plates 102 may vary depending upon various considerations, including the desired width of the cavity and thus the size of the composite pile column created by the cured filler and soil displacement pile 10, the condition of the soil such as the type and density of the soil, and the condition of the filler such as the consistency and density of the filler. As a non-limiting example and referring to FIG. 17, the diameter "$D_4$" of plate 102 may range from between about 6 inches to about 16 inches. The pitch "$P_4$" of the upper helical plate 102 may range from between about 2 inches and about 4 inches. The thickness "$T_4$" of the upper helical plate 102 may range from between about ¼ inch and about ½ inch. The upper helical plate 102 can be made of metal, e.g., steel or galvanized steel, or carbon fiber, or other suitable material known in the art.

Figure 14:
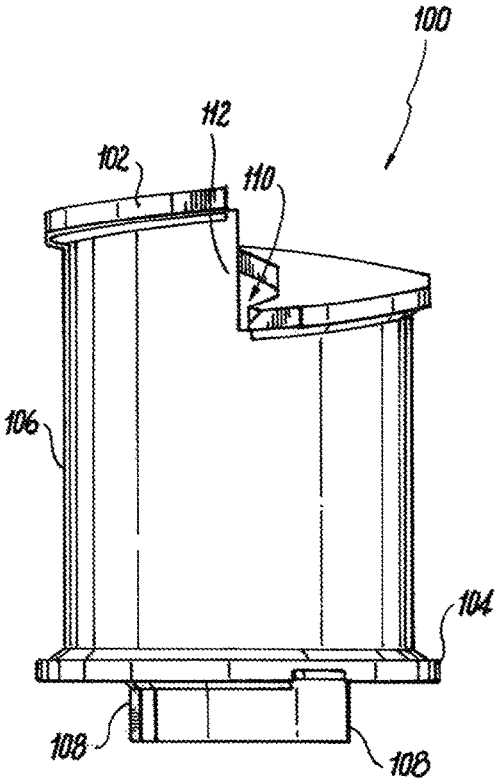
FIG. 14 is a side elevation view of the soil displacement assembly of FIG. 13.

The upper helical plate 102 includes a central opening 110, seen in FIG. 14. The central opening 110 is preferably shaped to conform to the shape of the lead shaft 16 or the extension shaft 24 so that the shaft 16 can pass through the soil displacement assembly 100 as described herein. The pitch of the upper plate 102 creates a gap 112 between the leading edge of the plate 102 and the trailing edge of the plate 102. This gap 112 permits filler 250 being poured into the cavity 200, seen in FIG. 12, to flow through the gap 112 into the reamer 106 to facilitate providing a continuous distribution of filler through the cavity. Having a formed upper plate 102 facilitates extraction of the soil displacement pile 10 from the cavity in the event the soil displacement pile 10 needs to be withdrawn after filler is poured into the cavity. More specifically, the formed upper plate 102 can cut through or screw into the filler, prior to the filler curing, when the soil displacement pile 10 is rotated in an opposite direction while trying to extract the soil displacement pile from the cavity.

The lower plate 104 is in this exemplary embodiment a circular, flat plate similar to lower plate 44 described above. The lower plate 104 includes a central opening 116, seen in FIGS. 13 and 15. The central opening 116 is preferably shaped to conform to the shape of the lead shaft 16 or the extension shaft 24 so that the shaft can pass through the soil displacement assembly 100 as described herein. The lower plate 104 may also include one or more filler holes 118, seen in FIG. 15. The filler holes 118 allow filler to flow from the reamer 106 through the lower plate 104 as the soil displacing pile 10 is driven into the soil. Referring to FIG. 16, the diameter "$D_5$" of the lower plate 104 depends upon a number of considerations including the desired width of the cavity and thus the size of the composite pile column to be created by the cured filler and soil displacement pile 10. For example, the diameter "$D_5$" of the lower plate 104 may range from between about 6 inches to about 16 inches. It should be noted that the diameters of the upper and lower plates 102 and 104 may be the same or they may differ. More specifically, the upper plate 102 may have a diameter that is larger than the lower plate 104, or the upper plate 102 may have a diameter that is smaller than the lower plate 104. For example, the diameter of the upper plate 102 may be about 16 inches and the diameter of the lower plate 104 may be 6 inches. As another example, the diameter of the upper plate 102 may be about 8 inches and the diameter of the lower helical plate 104 may be 12 inches. The lower plate 104 has a thickness "$T_5$" that is suitable to perform the soil displacement function of the soil displacement assembly 10. As a non-limiting illustration, the thickness "$T_5$" of the lower plate may be in the range from between about ⅜ of an inch to about ¾ of an inch. The lower plate 104 can be made of metal, e.g., steel or galvanized steel, or carbon fiber, or other suitable material known in the art.

The reamer 106 is secured to the upper and lower plates 102 and 104 by for example, welds, mechanical fasteners or other known fastening techniques, as shown in FIG. 14. The reamer 106 is preferably hollow so that the shaft 16 of the lead 12 or the shaft 24 of the extension 14 can pass through the reamer 106 as described herein. However, as noted above, the reamer 106 may be solid. In the exemplary embodiment shown in FIGS. 13-15, the reamer 106 is circular or tubular in shape. However, one skilled in the art would readily appreciate that the reamer 106 may have a square shape, a hexagon shape, a pentagon shape or other shape suitable to provide lateral stability to the lead or extension. The reamer 106 may also maintain the shape of the cavity 200 in which filler 250 can be poured. The diameter "$D_6$" or outer width of the reamer 106 is preferably less than the diameter of the smaller of the plates 102 or 104. The upper and lower plates 102 and 104 are separated by the reamer 106, such that the length "$L_R$" of the reamer 106 defines the separation between the upper and lower plates 102 and 104. The length "$L_R$" is based upon various considerations, including for example, the diameter of the upper and lower plates 102 and 104, and the expansion and/or contraction properties of the soil. As a non-limiting example, the length "$L_R$" can range from between about 5 inches to about 16 inches. Further, one skilled in the art would recognize that the size, shape and length of the reamer 106 may vary depending upon various considerations, including for example, the shape of the upper and lower plates 102 and 104, the expansion and/or contraction properties of the soil, the capacity requirements of the soil displacement pile 10, and the strength and/or type of soil. As a non-limiting example, in the exemplary embodiment of FIGS. 13-17, the formed upper plate 102 is a helical plate such that the shape of the upper area 106*a* of the reamer 106 is shaped to conform to the shape of the helical plate 102 so that the upper area 106*a* of the reamer 106 has a matching helix-like shape allowing the upper plate to sit flush with the reamer 106. The reamer 106 can be made of metal, e.g., steel or galvanized steel, or carbon fiber, or other suitable material known in the art.

Figure 15:
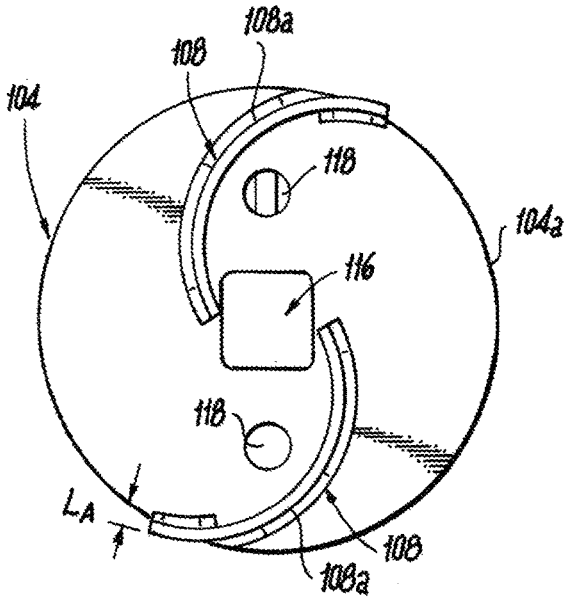
FIG. 15 is a bottom plan view of the soil displacement assembly of FIG. 13, illustrating the lower plate, the soil displacement arms attached to the lower plate and filler openings in the lower plate.
Figure 16:
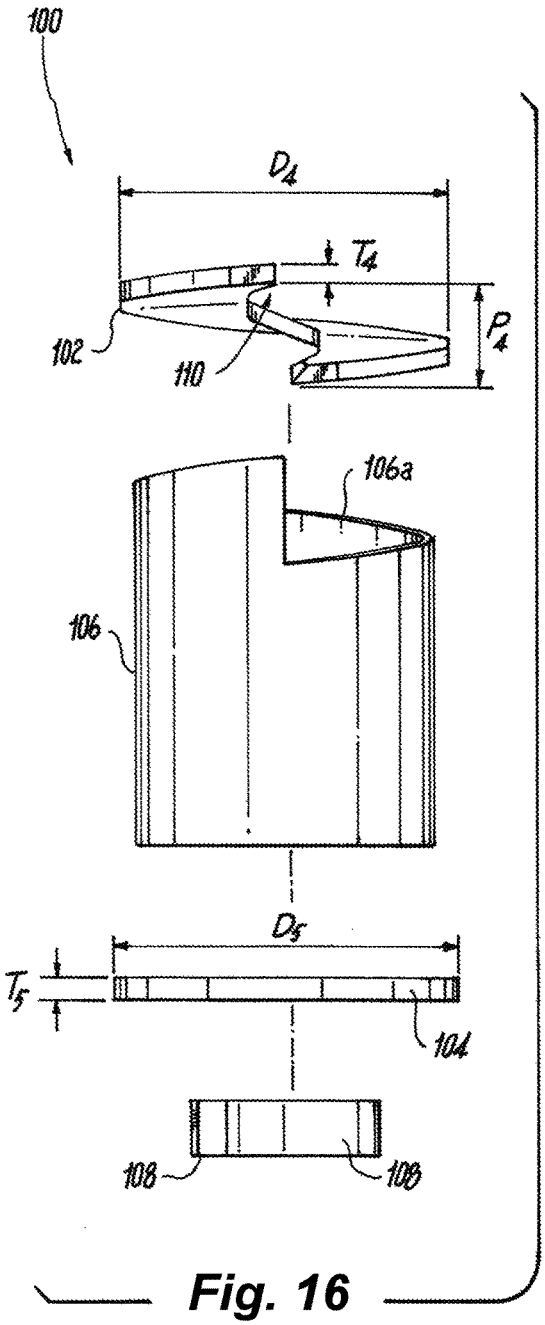
FIG. 16 is a side elevation view with parts separated of the soil displacement assembly of FIG. 14.
Figure 17:
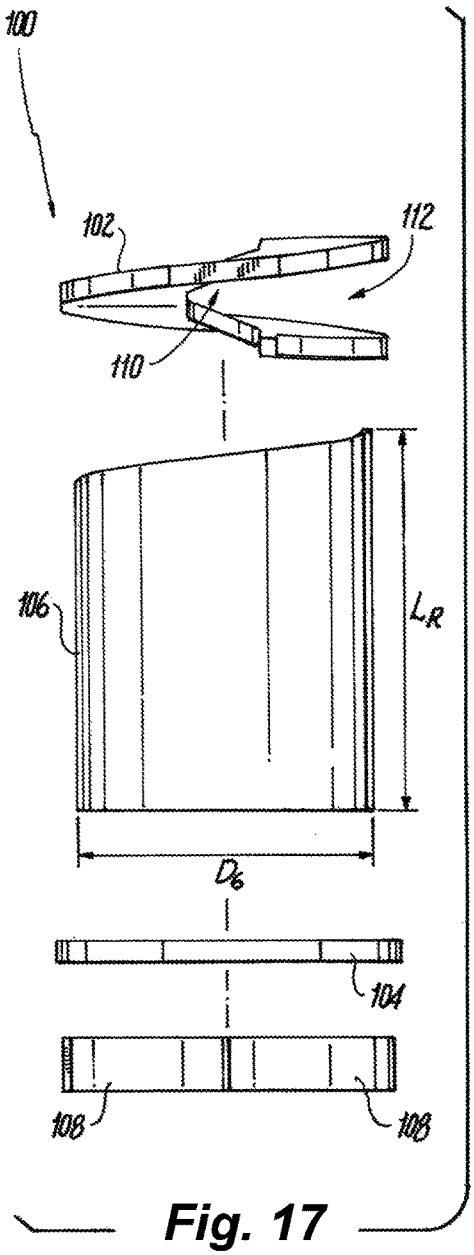
FIG. 17 is another side elevation view with parts separated of the soil displacement assembly of FIG. 14.

The one or more soil displacement arms or paddles 108 are secured to a bottom surface of the lower plate 104, as shown in FIG. 15. In the embodiment shown, there are two soil displacement arms 108. Each soil displacement arm 108 is arcuate in shape and preferably has a first end positioned adjacent an outer edge 104*a* of the lower plate 104 and a second end adjacent the central opening 116, as shown. Preferably, the first end of each soil displacement arm 108 extends beyond the outer edge 104*a* of the lower plate a distance "$L_A$." As described above, the distance "$L_A$" is preferably set so that the soil displacement arms 108 can push the soil so as to displace the soil radially outwardly away from a shaft of the soil displacement pile lead and any extensions to form the cavity 200 in which filler 250 can be poured. As a non-limiting example, the distance "$L_A$" can be in the range from between about 0 and about ¾ of an inch. In another embodiment, each soil displacement arm 108 may have a first end positioned adjacent an outer edge 104*a* of the lower plate 104 as described above, and a second end ending at a point between the outer edge 104*a* and the central opening 116. To facilitate the pushing of the soil, each soil displacement arm 108 is oriented on the lower plate 104 so that a soil contacting surface 108*a*, e.g., the convex surface, can engage the soil as the soil displacement pile 10 is being driven into the soil. In the embodiment shown, the soil contacting surfaces 108*a* are oriented so that clockwise motion of the soil displacement pile 10 causes the soil contacting surfaces to engage the soil.

As noted, each soil displacement arm 108 shown is arcuate such that it has a curvature. The radius of the curvature of the soil displacement arm 108 may vary depending upon, for example, the type of soil to be encountered and the relative density of the soil to be encountered. The radius of the curvature of each soil displacement arm 108 may be in the range of about 30 degrees to about 180 degrees. In another embodiment, the soil contacting surface 108*a* may vary and may be irregular so long as the soil contacting surface 108*a* is capable of displacing soil outwardly as the soil displacement pile 10 is being driven into the soil.

The vertical orientation of each soil displacement arm 108 may vary depending upon a number of considerations such as the location along the lower plate and the radius of curvature. For example, in the configuration shown in FIGS. 15-17, the soil displacement arms 108 are secured to the lower plate 104 so that the soil displacement arms 108 would be substantially vertical relative to the plate or the shaft 16 of the lead 12 or the shaft 24 of the extension 14 passing through the central opening 116. As another example, each soil displacement arm 108 may be angled or tilted relative to the plate or the shaft 16 of the lead 12 or the shaft 24 of the extension 14 passing through the central opening 116.

Referring now to FIGS. 18-22, another exemplary embodiment of a soil displacement assembly 150 according to the present disclosure that can be included on the lead 12 or one or more extensions 14 is shown. The soil displacement assembly 150 according to this exemplary embodiment includes, an upper plate 152, a lower plate 154, a reamer 156 and one or more soil displacement arms or paddles 158.

The upper plate 152 is in this exemplary embodiment a circular, flat plate similar to upper plate 42 described above. The upper plate 152 includes a central opening similar to the central opening in upper plate 42. As described, the central opening is preferably shaped to conform to the shape of the lead shaft 16 or the extension shaft 24 so that the shaft can pass through the soil displacement assembly 150 as described herein. The upper plate 152 may also include one or more filler holes similar to the filler 56 in upper plate 42. The filler holes allow filler to flow through the upper plate 152 into the reamer 156 as the soil displacing pile 10 is driven into the soil. The diameter "$D_9$" of the upper plate 152 depends upon a number of considerations including the desired width of the cavity and thus the size of the composite pile column created by the cured filler and soil displacement pile 10. For example, the diameter "$D_9$" of the upper plate 152 may range from between about 6 inches to about 16 inches. The upper plate 152 has a thickness "$T_9$" that is suitable to perform the soil displacement function of the soil displacement assembly 10. As a non-limiting illustration, the thickness "$T_9$" of the upper plate may be in the range from between about ⅜ of an inch and about ¾ of an inch. The upper plate 152 can be made of metal, e.g., steel or galvanized steel, or carbon fiber, or other suitable material known in the art.

The lower plate 154 is in this exemplary embodiment includes two semi-circular, formed plates 154*a* and 154*b* that when attached to the reamer 156 form a helical-like plate 154. The dimensions of the helical plate portions 154*a* and 154*b* may vary depending upon various considerations, including the desired width of the cavity and thus the size of the composite pile column created by the cured filler and soil displacement pile 10, the condition of the soil such as the type and density of the soil and the condition of the filler such as the consistency and density of the filler. As a non-limiting example and referring to FIG. 20, the diameter "$D_8$" of plate portions 154*a* and 154*b* may range from between about 6 inches to about 16 inches. The pitch "$P_8$" of the plate portions 154*a* and 154*b* may range from between about 2 inches and about 4 inches. The thickness "$T_8$" of the plate portions 154*a* and 154*b* may range from between about ¼ inch and about ½ inch. The lower plate 154 can be made of metal, e.g., steel or galvanized steel, or carbon fiber, or other suitable material known in the art.

Figure 21:
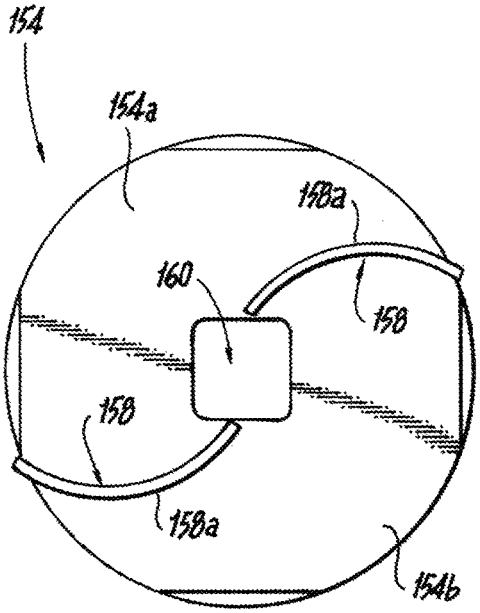
FIG. 21 is a bottom plan view of the soil displacement assembly of FIG. 18, illustrating the formed split lower plate and the soil displacement arms attached to the split lower plate.
Figure 22:
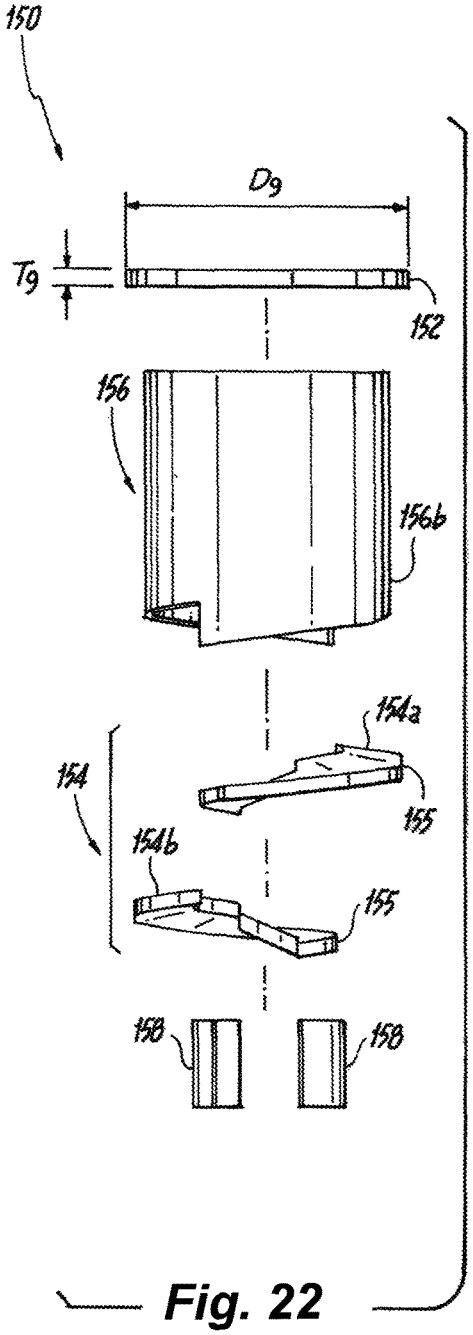
FIG. 22 is a side elevation view with parts separated of the soil displacement assembly of FIG. 19.
Figure 23:
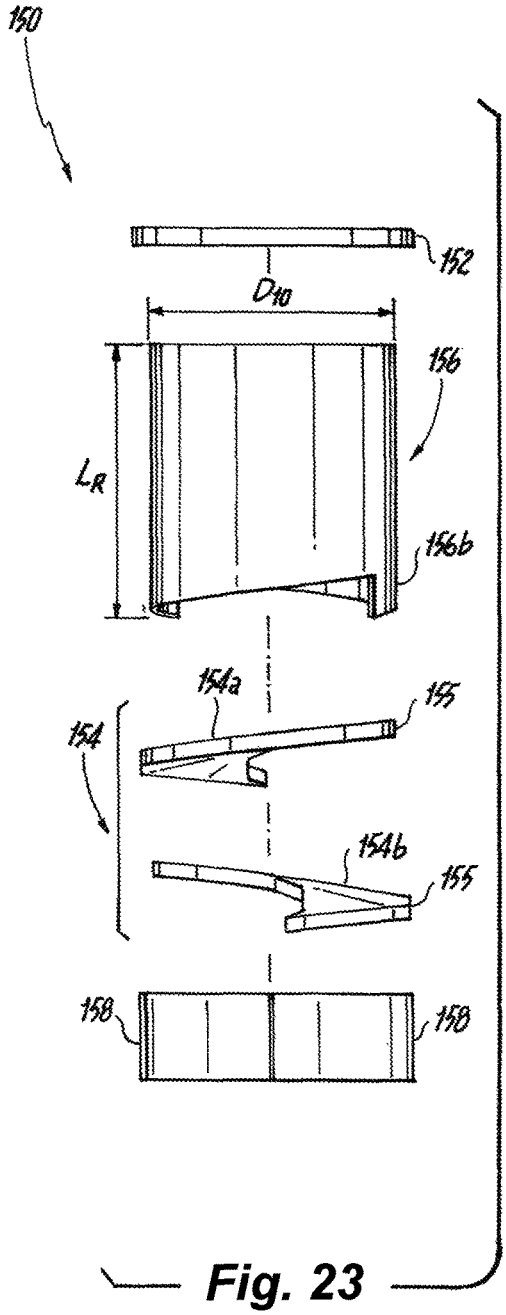
FIG. 23 is another side elevation view with parts separated of the soil displacement assembly of FIG. 19.
Figure 24:
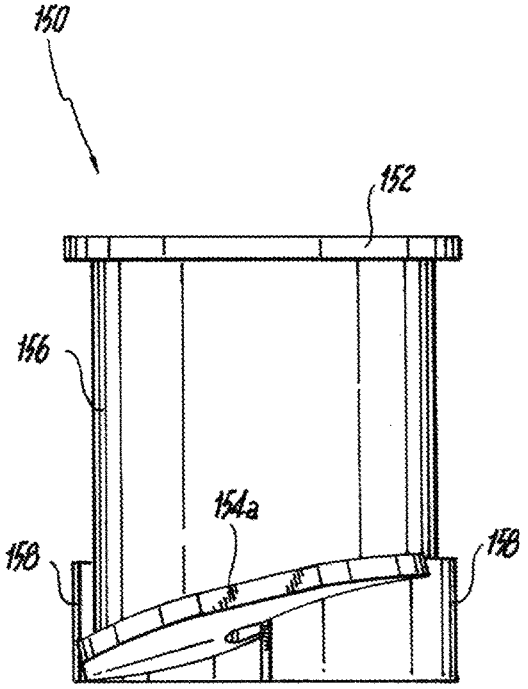
FIG. 24 is a side elevation view of another exemplary embodiment of a soil displacement assembly according to the present disclosure, illustrating a flat upper plate, a flat split lower plate, a reamer between the upper and lower plates and soil displacement arms attached to the lower plate.
Figure 25:
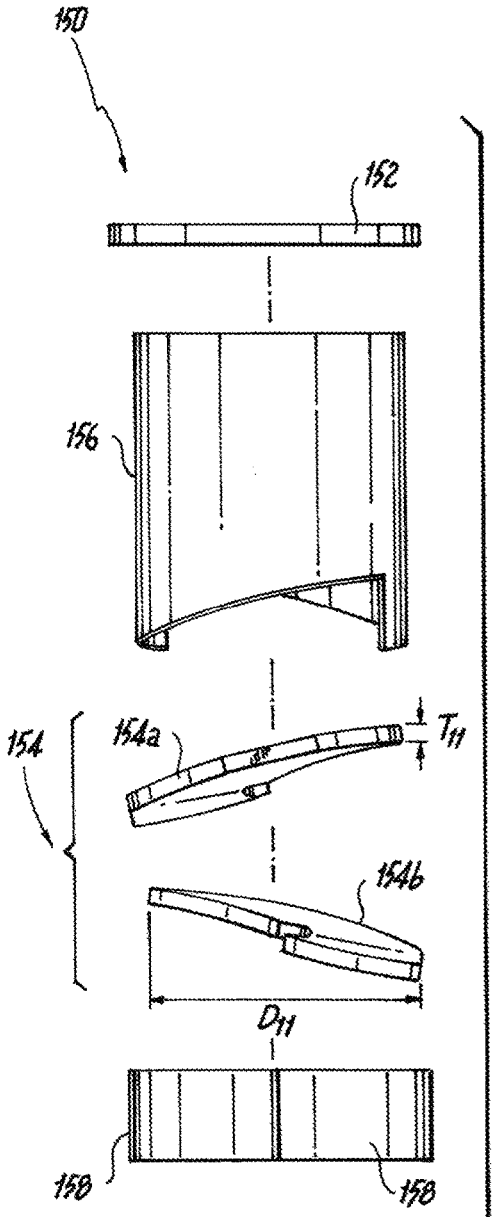
FIG. 25 is a side elevation view with parts separated of the soil displacement assembly of FIG. 24.
Figure 26:
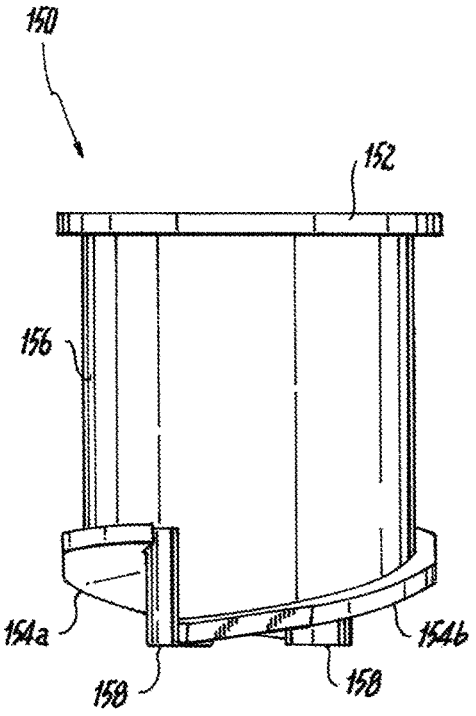
FIG. 26 is another side elevation view of the soil displacement assembly of FIG. 24.
Figure 27:
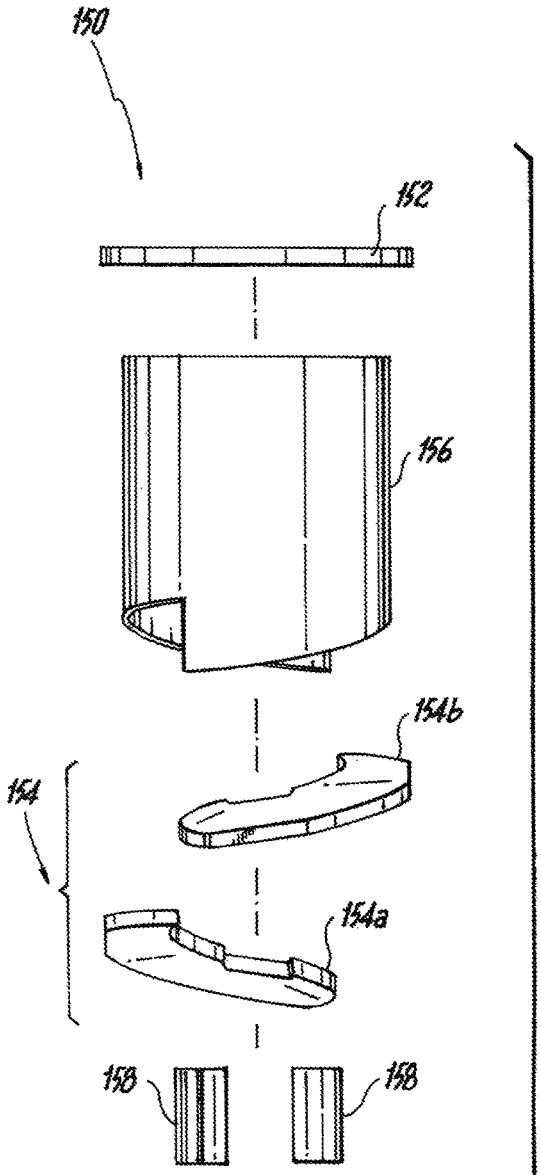
FIG. 27 is a side elevation view with parts separated of the soil displacement assembly of FIG. 26.

The lower plate portions 154*a* and 154*b* when attached to the reamer 156 includes a central opening 160, seen in FIG. 21. The central opening 160 is preferably shaped to conform to the shape of the lead shaft 16 or the extension shaft 24 so that the shaft can pass through the soil displacement assembly 150 as described herein. The pitch of the lower plate portions 154*a* and 154*b* creates a gap 112 as shown in FIG. 14 between the leading edge of the plate and the trailing edge of the plate. This gap 112 permits filler 250 being poured into the cavity 200, seen in FIG. 12, to flow out of the reamer 156 to facilitate providing a continuous distribution of filler 250 through the cavity 200. It should be noted that the diameter of the upper plate 152 and the diameter of the lower plate portions 154*a* and 154*b* may be the same or they may differ. More specifically, the upper plate 152 may have a diameter that is larger than the lower plate 154, or the upper plate 152 may have a diameter that is smaller than the lower plate 154. For example, the diameter $D_7$ of the upper plate 152 may be about 16 inches and the diameter of the lower plate 154 may be 6 inches. As another example, the diameter of the upper plate 152 may be about 8 inches and the diameter of the lower helical plate 154 may be 12 inches. The upper plate 152 has a thickness $T_7$ that is suitable to perform soil displacement functions of the soil displacement assembly 10. Having a formed lower plate 154 provides additional stability to the soil displacement arms 158 as described below.

Figure 18:
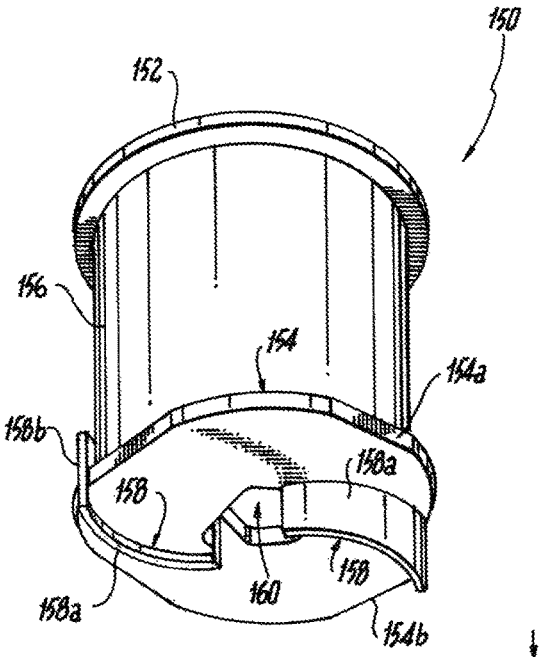
FIG. 18 is a bottom perspective view of another exemplary embodiment of a soil displacement assembly according to the present disclosure, illustrating a flat upper plate, a formed split lower plate, a reamer between the upper and lower plates and soil displacement arms attached to the lower plate.
Figure 19:
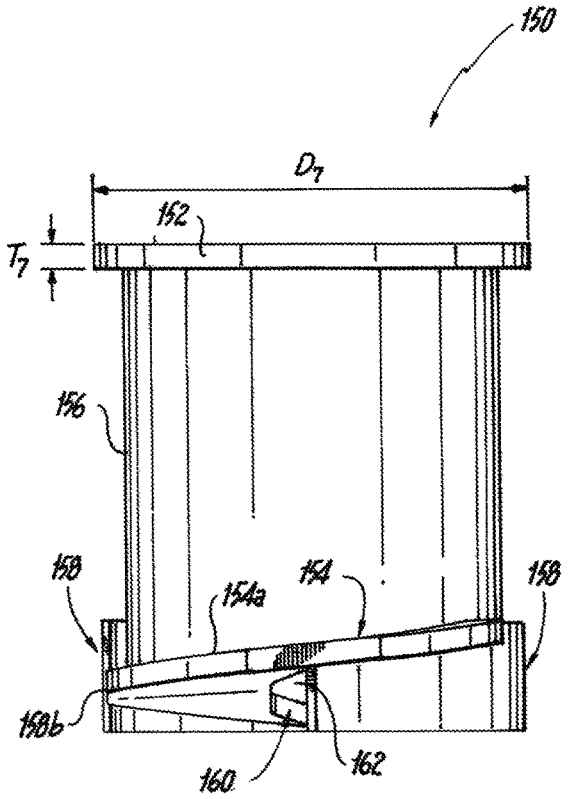
FIG. 19 is a side elevation view of the soil displacement assembly of FIG. 18.
Figure 20:
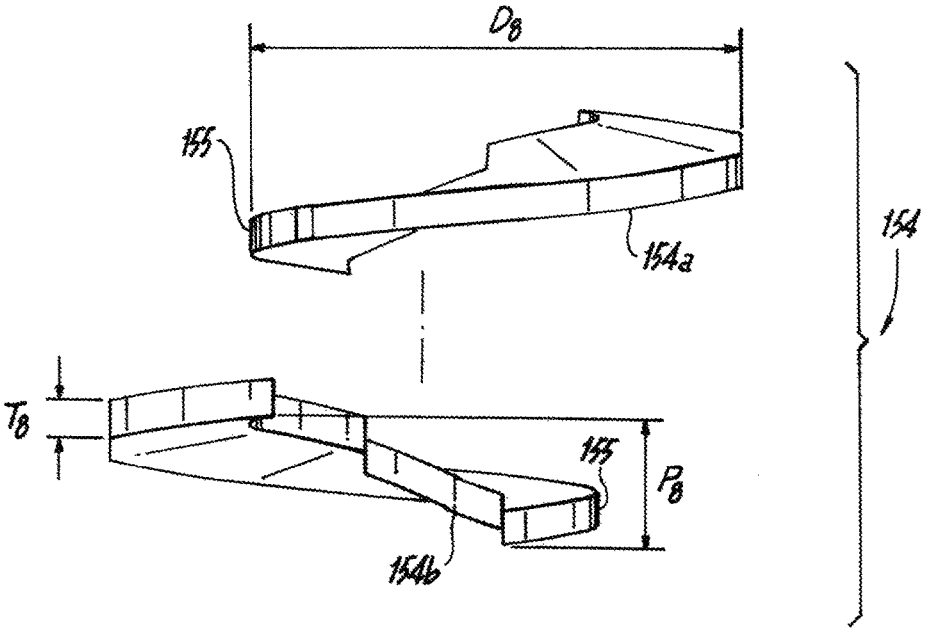
FIG. 20 is a side elevation view of the formed split lower plate of FIG. 18.

The reamer 156 is secured to the upper plate 152 and the lower plate portions 154*a* and 154*b* by for example, welds, mechanical fasteners or other known fastening techniques, as shown in FIGS. 18 and 19. The reamer 156 is preferably hollow so that the shaft 16 of the lead 12 or the shaft 24 of the extension 14 can pass through the reamer 156 as described herein. However, the reamer 156 may be solid as described above. In the exemplary embodiment shown in FIGS. 18-23, the reamer 156 is circular or tubular in shape. However, one skilled in the art would readily appreciate that the reamer 156 may have a square shape, a hexagon shape, a pentagon shape or other shape suitable to provide lateral stability to the lead or extension. The reamer 156 may also maintain the shape of the cavity in which filler can be poured. The diameter "$D_{10}$" or outer width of the reamer 156 is preferably less than the diameter of the smaller of the plates 152 or 154. The upper and lower plates 152 and 154 are separated by the reamer 156, such that the length "$L_R$" of the reamer 156 defines the separation between the upper and lower plates. The distance "$L_R$" is based upon various considerations, including for example, the diameter of the upper and lower plates 152 and 154, and the expansion and/or contraction properties of the soil. As a non-limiting example, the distance "$L_R$" can range from between about 5 inches to about 16 inches. Further, one skilled in the art would recognize that the size, shape and length of the reamer 156 may vary depending upon various considerations, including for example, the shape of the upper and lower plates 152 and 154, the expansion and/or contraction properties of the soil, the capacity requirements of the soil displacement pile 10, and the strength and/or type of soil. For example, in the exemplary embodiment of FIGS. 18-23, the lower plate 154 is a split helical plate having two portions 154*a* and 154*b*, such that the shape of the lower area 156*b* of the reamer 156 is shaped to conform to the shape of the helical plate portions 154*a* and 154*b* so that the lower area 156*b* of the reamer has a matching helix-like shape allowing the lower plate portions 154*a* and 154*b* to sit flush with the reamer 156. The reamer 156 can be made of metal, e.g., steel or galvanized steel, or carbon fiber, or other suitable material known in the art.

In this exemplary embodiment, there are two soil displacement arms or paddles 158 secured to the plate portions 154*a* and 154*b* at the leading and trailing edges of the plate portions 154*a* and 154*b*, as shown in FIGS. 18 and 19. By securing the soil displacement arms 158 to the plate portions 154*a* and 154*b* in this way the soil displacement arms 158 are between the plate portions 154*a* and 154*b* such that a leading edge of each plate portion 154*a* and 154*b* is secured to a central portion 158*b* of the soil displacement arm 158 allowing the leading edge of the plate portion to act as a gusset providing the additional stability to the soil displacement arms 158 as the soil displacement pile 10 is driven into the soil.

Each soil displacement arm 158 is arcuate in shape and preferably has a first end positioned adjacent an outer edge 155 of the lower plate portion 154*a* and 154*b* and a second end adjacent the central opening 160, as shown. Preferably, the first end of each soil displacement arm 158 extends beyond the outer edge 155 of the lower plate 154 a distance "$L_A$" as described above. As described, the distance "$L_A$" is preferably set so that the soil displacement arms 108 can push the soil so as to displace the soil radially outwardly away from a shaft of the soil displacement pile lead and any extensions to form the cavity in which filler can be poured. For example, the distance "$L_A$" as shown in FIG. 7, can be in the range from between about 0 and about ¾ of an inch. In another embodiment, each soil displacement arm 158 may have a first end positioned adjacent an outer edge 155 of the lower plate 154 as described above, and a second end ending at a point between the outer edge 155 and the central opening 160. To facilitate the pushing of the soil, each soil displacement arm 158 is oriented relative to the lower plate portions 154*a* and 154*b* so that a soil contacting surface 158*a*, e.g., the convex surface, can engage the soil as the soil displacement pile 10 is being driven into the soil. In the embodiment shown, the soil contacting surfaces 158*a* are oriented so that clockwise motion of the soil displacement pile 10 causes the soil contacting surfaces to engage the soil.

As noted, each soil displacement arm 158 shown is arcuate such that it has a curvature. The radius of the curvature of the soil displacement arm 158 may vary depending upon, for example, the type of soil to be encountered and the relative density of the soil to be encountered. The radius of the curvature of each soil displacement arm 158 may be in the range of about 30 degrees to about 180 degrees. In another embodiment, the soil contacting surface 158*a* may vary and may be irregular so long as the soil contacting surface 158*a* is capable of displacing soil outwardly as the soil displacement pile 10 is being driven into the soil.

The vertical orientation of each soil displacement arm 158 may vary depending upon a number of considerations such as the location along the lower plate portions and the radius of curvature. For example, in the configuration shown in FIGS. 18-23, the soil displacement arms 158 are substantially vertical relative to the plate portions 154*a* and 154*b* or the shaft 16 of the lead 12 or the shaft 24 of the extension 14 passing through the central opening 160. As another example, each soil displacement arm 158 may be angled or tilted relative to the plate portions or the shaft 16 of the lead 12 or the shaft 24 of the extension 14 passing through the central opening 160.

Referring now to FIGS. 24-27 another exemplary embodiment of the lower plate 154 of the soil displacement assembly 150 is shown. In this exemplary embodiment, the lower plate portions 154*a* and 154*b* are semi-circular, flat plates that when attached to the reamer 156 form a helix-like structure as shown. The dimensions of the flat plate portions 154*a* and 154*b* may vary depending upon various considerations, including the desired width of the cavity and thus the size of the composite pile column created by the cured filler and soil displacement pile 10, the condition of the soil such as the type and density of the soil, and the condition of the filler such as the consistency and density of the filler. As a non-limiting example and referring to FIG. 25, the diameter "$D_{11}$" of plate portions 154*a* and 154*b* may range from between about 6 inches to about 16 inches. The thickness "$T_{11}$" of the plate portions 154*a* and 154*b* may range from between about ¼ inch and about ½ inch. The lower plate portions 154*a* and 154*b* in this exemplary embodiment can be made of metal, e.g., steel or galvanized steel, or carbon fiber, or other suitable material known in the art.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A soil displacement assembly for penetrating and forming a cavity in soil, the soil displacement assembly comprising:

an upper plate having a central opening configured to receive a shaft of a pile lead or extension;

a lower plate having a central opening configured to receive the shaft of a pile lead or extension;

a reamer between the upper and lower plate and secured to each plate, wherein the upper plate, the lower plate and the reamer form a unitary structure that can slide along the shaft when penetrating the soil; and at least one soil displacement arm extending from the lower plate and having a soil contacting surface capable of displacing soil radially outwardly.

2. The soil displacement assembly according to claim 1, wherein the upper plate is a circular, flat plate.

3. The soil displacement assembly according to claim 1, wherein the lower plate is a circular, flat plate.

4. The soil displacement assembly according to claim 1, wherein the reamer is circular in shape.

5. The soil displacement assembly according to claim 1, wherein the reamer is hollow such that the shaft of a pile lead or extension can pass through the reamer.

6. The soil displacement assembly according to claim 1, wherein the at least one soil displacement arm is substantially perpendicular relative to the lower plate.

7. The soil displacement assembly according to claim 1, wherein the at least one soil displacement arm is positioned at an angle relative to the lower plate.

8. The soil displacement assembly according to claim 1, wherein the upper plate is circular and has a diameter in the range of between about 6 inches and about 16 inches.

9. The soil displacement assembly according to claim 1, wherein the lower plate is circular and has a diameter in the range of between about 6 inches and about 16 inches.

10. The soil displacement assembly according to claim 1, wherein the upper plate is configured and dimensioned the same as the lower plate.

11. The soil displacement assembly according to claim 1, wherein the at least one soil displacement arm is a curved plate and the soil contacting surface of the curved plate is a convex surface of the curved plate.

12. The soil displacement assembly according to claim 1, wherein the at least one soil displacement arm comprises a plurality of soil displacement arms extending from the lower plate.

13. A soil displacement pile comprising:

a shaft; and at least one soil displacement assembly coupled to the shaft, the at least soil displacement assembly comprising:

an upper plate having a central opening configured to receive a shaft of a pile lead or extension;

a lower plate having a central opening configured to receive the shaft of a pile lead or extension;

a reamer between the upper and lower plate and secured to each plate, wherein the upper plate, the lower plate and the reamer form a unitary structure that can slide along the shaft when penetrating soil; and at least one soil displacement arm extending from the lower plate and having a soil contacting surface capable of displacing soil radially outwardly.

14. The soil displacement pile according to claim 13, wherein the upper plate is a circular, flat plate.

15. The soil displacement pile according to claim 13, wherein the lower plate is a circular, flat plate.

16. The soil displacement pile according to claim 13, wherein the reamer is circular in shape.

17. The soil displacement pile according to claim 13, wherein the reamer is hollow such that the shaft of a pile lead or extension can pass through the reamer.

18. The soil displacement pile according to claim 13, wherein the at least one soil displacement arm is substantially perpendicular relative to the lower plate.

19. The soil displacement pile according to claim 13, wherein the at least one soil displacement arm is positioned at an angle relative to the lower plate.

20. The soil displacement pile according to claim 13, wherein the upper plate is circular and has a diameter in the range of between about 6 inches and about 16 inches.

21. The soil displacement pile according to claim 13, wherein the lower plate is circular and has a diameter in the range of between about 6 inches and about 16 inches.

22. The soil displacement pile according to claim 13, wherein the upper plate is configured and dimensioned the same as the lower plate.

23. The soil displacement pile according to claim 13, wherein the at least one soil displacement arm is a curved plate and the soil contacting surface of the curved plate is a convex surface of the curved plate.

24. The soil displacement pile according to claim 13, wherein the at least one soil displacement arm comprises a plurality of soil displacement arms extending from the lower plate.

25. A soil displacement pile comprising:

a lead shaft having a lead head portion, a lead end portion and at least one plate secured to the lead shaft toward the lead end portion;

at least one soil displacement assembly coupled to the lead shaft;

an extension shaft having an extension head portion and an extension end portion;

at least one soil displacement assembly coupled to the extension shaft;

wherein the at least soil displacement assembly on the lead shaft and the extension shaft comprises:

an upper plate having a central opening configured to receive the lead shaft or the extension shaft;

a lower plate having a central opening configured to receive the lead shaft or the extension shaft;

a reamer between the upper and lower plate and secured to each plate, wherein the upper plate, the lower plate and the reamer form a unitary structure that can slide along the respective shaft when penetrating soil; and at least one soil displacement arm extending from the lower plate and having a soil contacting surface capable of displacing soil radially outwardly.

26. The soil displacement pile according to claim 25, wherein the upper plate is a circular, flat plate.

27. The soil displacement pile according to claim 25, wherein the lower plate is a circular, flat plate.

28. The soil displacement pile according to claim 25, wherein the reamer is circular in shape.

29. The soil displacement pile according to claim 25, wherein the reamer is hollow such that the shaft of a pile lead or extension can pass through the reamer.

30. The soil displacement pile according to claim 25, wherein the at least one soil displacement arm is substantially perpendicular relative to the lower plate.

31. The soil displacement pile according to claim 25, wherein the at least one soil displacement arm is positioned at an angle relative to the lower plate.

32. The soil displacement pile according to claim 25, wherein the upper plate is circular and has a diameter in the range of between about 6 inches and about 16 inches.

33. The soil displacement pile according to claim 25, wherein the lower plate is circular and has a diameter in the range of between about 6 inches and about 16 inches.

34. The soil displacement pile according to claim 25, wherein the upper plate is configured and dimensioned the same as the lower plate.

35. The soil displacement pile according to claim 25, wherein the at least one soil displacement arm is a curved plate and the soil contacting surface of the curved plate is a convex surface of the curved plate.

36. The soil displacement pile according to claim 25, wherein the at least one soil displacement arm comprises a plurality of soil displacement arms extending from the lower plate.

* * * * *